US006229967B1

(12) United States Patent
Miya et al.

(10) Patent No.: US 6,229,967 B1
(45) Date of Patent: May 8, 2001

(54) TRANSFER UNIT WITH PROVISION FOR DETECTING WHETHER IT IS AN UNUSED UNIT OR NOT AND RECORDING APPARATUS EQUIPPED THEREWITH

(75) Inventors: Shigeyuki Miya; Hiromichi Miyoshi, both of Utsunomiya (JP)

(73) Assignee: Matsushita Graphic Communications Systems, Inc., Tokyo (JP)

( * ) Notice: Subject to any disclaimer, the term of this patent is extended or adjusted under 35 U.S.C. 154(b) by 0 days.

(21) Appl. No.: 09/596,199

(22) Filed: Jun. 16, 2000

(30) Foreign Application Priority Data

Jul. 12, 1999 (JP) ..... 11-197453

(51) Int. Cl.[7] ..... G03G 15/00; G03G 21/16; G03G 21/12

(52) U.S. Cl. ..... 399/12; 399/111; 399/360

(58) Field of Search ..... 399/111, 121, 399/116, 114, 12, 13, 25, 24, 162, 303, 313, 358, 360

(56) References Cited

U.S. PATENT DOCUMENTS 4,963,939 * 10/1990 Kurando et al. ..... 399/12
5,596,388 * 1/1997 Ohkubo et al. ..... 399/111
5,946,521 * 8/1999 Budnik et al. ..... 399/24
5,995,772 * 11/1999 Barry et al. ..... 399/12

* cited by examiner

*Primary Examiner*—Susan S. Y. Lee
(74) *Attorney, Agent, or Firm*—Greenblum & Bernstein, P.L.C.

(57) ABSTRACT

The present invention provides a recording apparatus capable of detecting whether a transfer unit is an unused unit or not, including a cover that covers a transfer medium over which a plurality of color images is superimposed to form a color image and has an opening that exposes part of the transfer medium, pasting one end of a seal for detecting whether the transfer unit is an unused unit or not near the opening of the cover in the direction in which the transfer medium moves, pasting the other end of the unused unit detecting seal to the transfer medium through the opening. This allows one end of the unused unit detecting seal to be pasted to the transfer medium through the opening and the other end of the seal to be pasted to the cover near the opening in the direction in which the transfer medium moves. With the unused unit detecting seal pasted in this way, it is possible to detect whether this transfer unit is an unused unit or not.

10 Claims, 6 Drawing Sheets

TRANSFER UNIT WITH PROVISION FOR DETECTING WHETHER IT IS AN UNUSED UNIT OR NOT AND RECORDING APPARATUS EQUIPPED THEREWITH

BACKGROUND OF THE INVENTION

1. Field of the Invention

The present invention relates to a recording apparatus, and more particularly, to a recording apparatus that transfers images to a recording sheet using a transfer film.

2. Description of the Related Art

In recent years, color recording is performed based on an electrophotographic system. In this type of color recording, a transfer film is used to superimpose images in 4 colors. That is, images in 4 colors are transferred to a same position to form a color image on a transfer film. This color image is further transferred to a recording sheet. When the transfer of the color image to the recording sheet is completed, used toner remaining on the transfer film is cleaned.

Conventionally, the cleaned used toner is collected in a used toner box. When the used toner box is filled with used toner, this used toner box is replaced. This used toner box is normally provided in a location different from the location where the transfer film is placed. The transfer film cleaning mechanism and the used toner box are connected via a pipe that carries used toner.

However, when the used toner box is replaced, such a conventional configuration requires the used toner box to be removed from the pipe. In this case, there is a problem that used toner leaks from the pipe, causing the recording apparatus interior to get soiled. Moreover, providing an additional mechanism that prevents soiling when the used toner box is removed from the pipe will increase the size of the recording apparatus due to the additional mechanism as well as costs due to increased number of parts.

In order to solve such a problem, a unit that combines the used toner box and transfer film (hereinafter referred to as "transfer unit") is provided in which the used toner box is housed in a space inside the transfer film circulation path. It is also possible to replace the entire transfer unit when the used toner box is filled with used toner.

According to such a recording apparatus, the entire transfer unit containing the used toner box is replaced, and therefore it is not necessary to remove the used toner box from the pipe. This prevents used toner from leaking, which will also prevent the recording apparatus interior, etc. from getting soiled. Housing the used toner box inside the transfer unit also reduces the size of the recording apparatus.

With such a recording apparatus, however, the transfer unit needs to be replaced not only when the used toner box in the transfer unit is filled with used toner, but also when the number of times the transfer film is developed reaches the maximum number of times the transfer film can be developed. Thus, since the number of times the transfer film is developed can reach the maximum number of times the transfer film can be developed before the used toner box in the transfer unit is filled with used toner, it is necessary to precisely control the development count of the transfer film.

Thus, every time the transfer unit is replaced it is detected whether the replaced transfer unit is an unused unit or not. If the transfer unit is an unused unit, it is necessary to reset the development count of the transfer film in this transfer unit and restart counting. Then, when this count reaches a predetermined value, the entire transfer unit is replaced. Therefore, with this recording apparatus it is necessary to detect whether the replaced transfer unit is an unused unit or not.

As a method for detecting whether the replaced transfer unit is an unused unit or not, it is possible to attach a fuse to the transfer unit which is blown out when the transfer unit is mounted and detect whether the transfer unit is an unused unit or not by the presence or absence of the fuse. However, such a detection method requires a circuit for burning out the fuse and a circuit for detecting the presence or absence of the fuse. This will increase the number of parts in the recording apparatus, causing a problem of increasing costs as well. Moreover, the necessity for providing an additional electric circuit will make the configuration of the recording apparatus complicated.

SUMMARY OF THE INVENTION

It is an object of the present invention to provide a recording apparatus capable of reliably detecting whether the transfer unit is an unused unit or not with a simple configuration without increasing the number of parts.

That is, the present invention provides a cover that covers a transfer medium on which a color image is formed by superimposing images of a plurality of colors, with an opening that exposes part of the transfer medium, pastes one end of an unused unit detection seal to near the opening in the direction in which the transfer medium moves and pastes the other end of the unused unit detection seal to the transfer medium through the opening to detect whether the transfer unit is an unused unit or not. In this way, one end of the unused unit detection seal is pasted to the transfer medium through the opening and the other end is pasted to the cover near the opening in the direction in which the transfer medium moves. Therefore, if the unused unit detection seal is pasted in such a way, it is possible to detect that this transfer unit is an unused unit.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

With reference now to the attached drawings, an embodiment of the present invention is explained in detail below.

Figure 1:
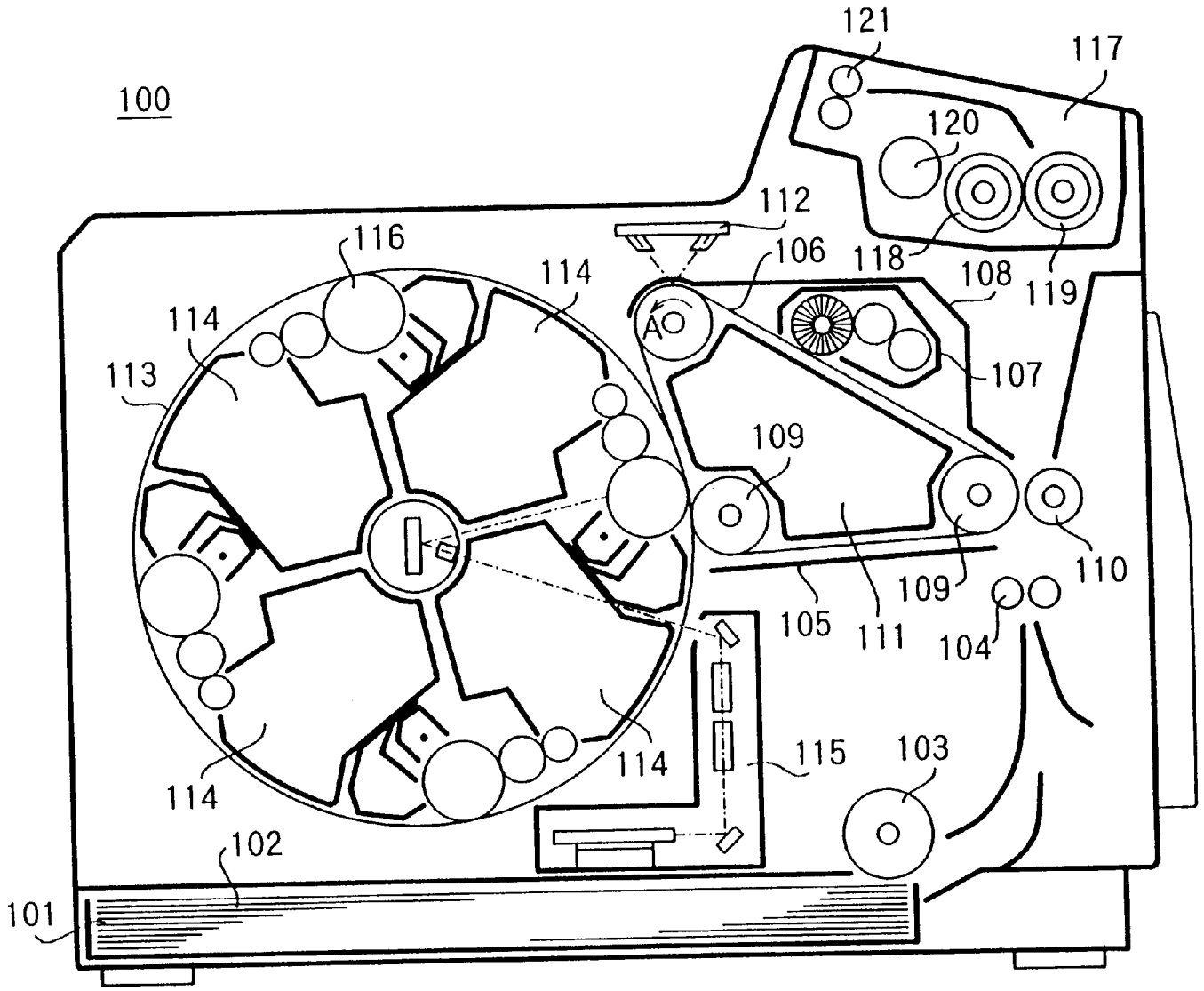
FIG. 1 is an outlined cross-sectional view showing a configuration of a recording apparatus having a transfer unit according to an embodiment of the present invention.

FIG. 1 is an outlined cross-sectional view showing a configuration of a recording apparatus according to an embodiment of the present invention. As shown in FIG. 1, this recording apparatus 100 has paper feed cassette 101 at the bottom. The top recording sheet of recording sheet bundle 102 is picked up from paper feed cassette 101 by pickup roller 103. The recording sheet picked up from paper feed cassette 101 is handed over to register roller 104. Transfer unit 105 is placed in an area directly ahead of register roller 104.

Transfer unit 105 consists of transfer film 106 over which 4 color images are superimposed and used toner cleaning apparatus 107. These are covered with cover 108 of transfer unit 105. Transfer film 106 is made of a material of low optical reflectivity such as a black material. Cover 108 has openings where transfer film 106 has contact with a process unit that will be described later and a recording sheet. Through these openings, transfer film 106 has direct contact with a photosensitive material and recording sheet. Transfer film 106 is supported by three transport rollers 109 and rotates in the direction indicated by arrow A by a drive motor, which is not shown in the figure. Transfer roller 110 is placed facing transport roller 109 placed where transfer film 106 has contact with the recording sheet. Transfer roller 110 transfers images superimposed over transfer film 106 to the recording sheet. Used toner box 111 is housed inside three transport rollers 109. Used toner box 111 is connected with cleaning apparatus 107 via a pipe. Used toner removed from transfer film 106 by cleaning apparatus 107 is conducted through the pipe and collected in used toner box 111. This transfer unit 105 is housed in this recording apparatus 100 in a detachable manner. Thus, when used toner box 111 is filled with used toner, entire transfer unit 105 can be replaced. This prevents used toner from leaking and soiling the interior of this recording apparatus 100.

Detection sensor 112 is placed in a predetermined location over transfer unit 105. Detection sensor 112 detects a register mark provided on transfer film 106.

Detection sensor 112 consists of a light-emitting device and photoreceptor device. Detection sensor 112 emits light toward a register mark through the opening on cover 108 of transfer unit 105 and detects the register mark by receiving reflected light from the register mark.

Process unit 113 is installed next to transfer unit 105. Process unit 113 contains 4 color process cartridges 114. LSU 115, which consists of a laser drive unit and polygon mirror, etc., forms an electrostatic latent image on photosensitive material 116 provided for every cartridge. The 4 color images created by 4 color process cartridges 114 are superimposed over a same area of transfer film 106. Transfer roller 110 transfers the images superimposed on transfer film 106 to the recording sheet. At this time, register roller 104 carries out positional adjustment between transfer film 106 and the end of the recording sheet.

The recording sheet with the image transferred is handed over from transfer unit 105 to fixing unit 117. Fixing unit 117 is equipped with fixing roller 118, pressurizing roller 119 and cleaning roller 120 that applies oil, which enhances the peeling off characteristic of toner remaining on fixing roller 118. Fixing roller 118 heats the recording surface of the recording sheet and pressurizing roller 119 pressurizes the recording sheet against fixing roller 118, and in this way the image is fixed to the recording sheet. Discharge roller 121 is provided at the outlet of fixing unit 117.

Figure 2:
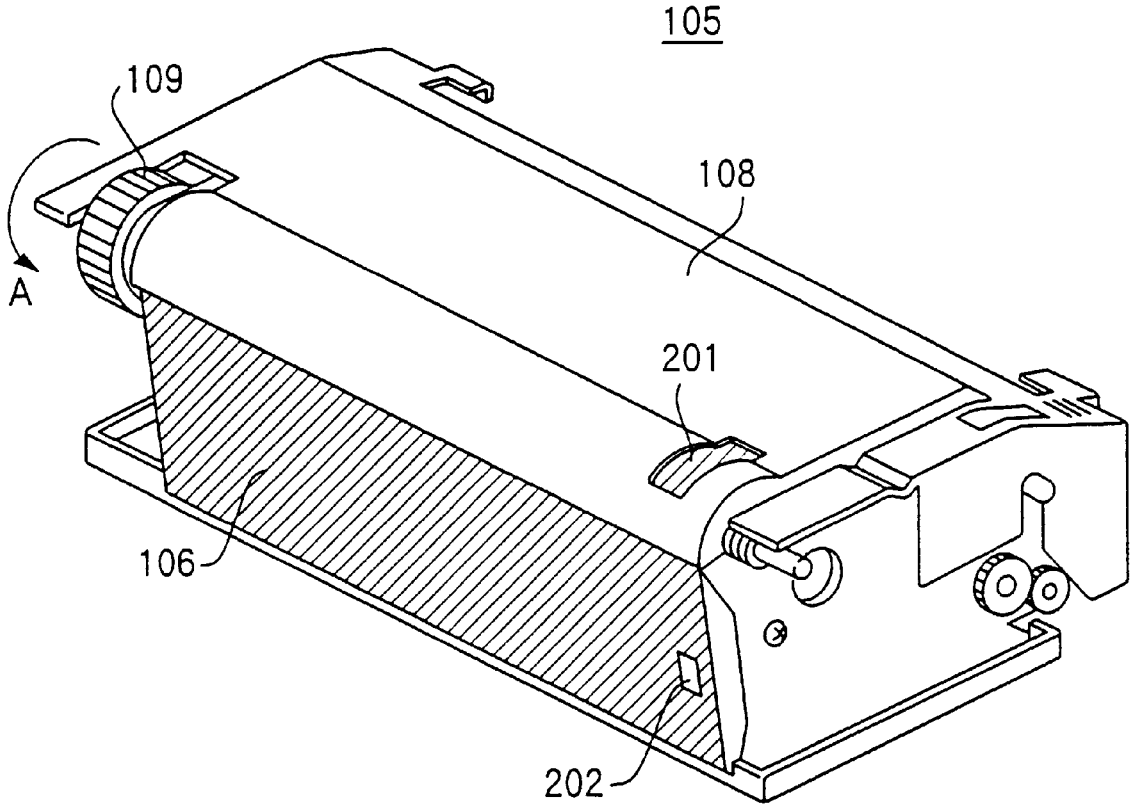
FIG. 2 is a perspective view of the transfer unit according to the embodiment above.

FIG. 2 shows a perspective view of transfer unit 105 above. As shown in FIG. 2, opening 201 is provided on cover 108 of transfer unit 105. When transfer unit 105 is mounted in recording apparatus 100, detection sensor 112 is placed directly above opening 201.

Furthermore, register mark 202 is provided in a predetermined position of transfer film 106 corresponding to opening 201. That is, when transfer film 106 rotates, register mark 202 passes beneath opening 201. Opening 201 is slightly bigger than register mark 202. Register mark 202 is made of a material of high optical reflectivity. Register mark 202 is used to determine the position of transfer film 106 to prevent images from deviating from the right position when 4 color images are superimposed over transfer film 106.

This recording apparatus 100 detects whether transfer unit 105 is an unused unit or not using such a configuration without increasing the number of parts. More specifically, recording apparatus 100 detects whether transfer unit 105 is an unused unit or not by adding a detection target to be detected by detection sensor 112. This allows recording apparatus 100 to grasp timing for replacing transfer unit 105. The following gives an explanation of the configuration and operation of recording apparatus 100 of detecting whether transfer unit 105 is an unused unit or not.

Figure 3:
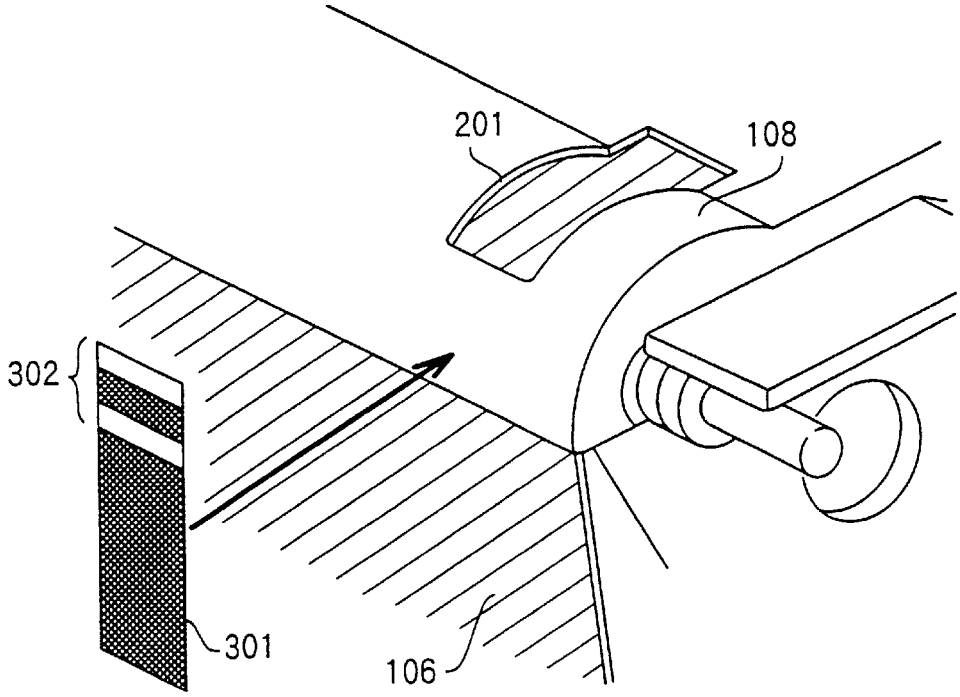
FIG. 3 is an enlarged view around an opening of the transfer unit according to the embodiment above.
Figure 4:
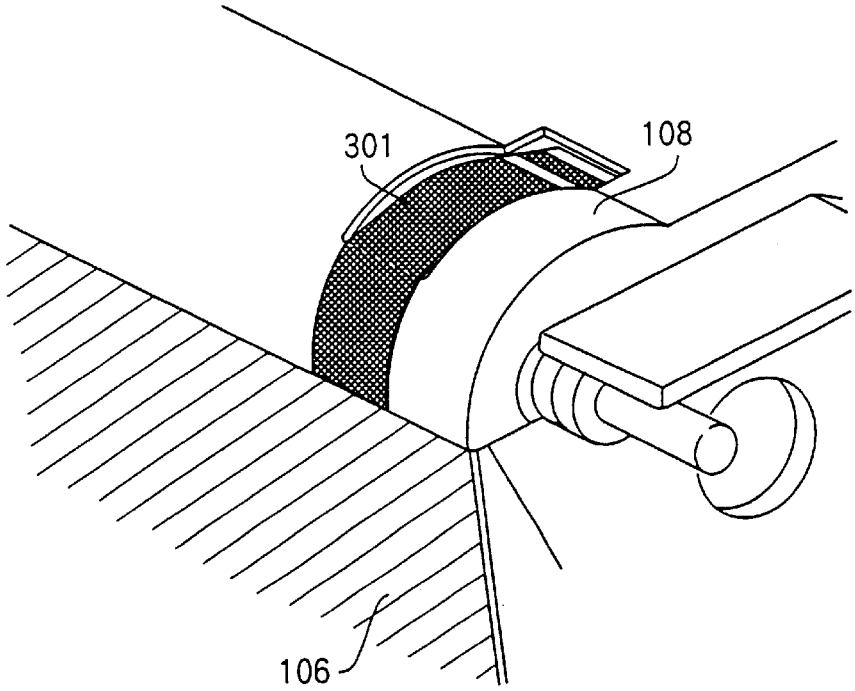
FIG. 4 is another enlarged view around the opening of the transfer unit according to the embodiment above.

FIG. 3 and FIG. 4 show enlarged views before and after identification tape 301 to be detected by detection sensor 112 is pasted so that recording apparatus 100 detects whether transfer unit 105 is an unused unit or not. In recording apparatus 100, identification tape 301 is pasted to unused transfer unit 105 near opening 201.

In FIG. 3 and FIG. 4, identification tape 301 is made of a material of low optical reflectivity such as a black material as in the case of transfer film 106. Identification mark 302, which will be described later, is provided on one end of the identification tape. Identification tape 301 is slightly narrower than opening 201 of transfer unit 105. One end of identification tape 301 is pasted to cover 108 beneath opening 201. In other words, one end of identification tape 301 is pasted to cover 108 in the direction in which transfer film 106 moves from opening 201. On the other hand, the other end of identification tape 301 is pasted to transfer film 106 through opening 201.

Here, identification tape 301 is pasted so that its one end pasted to cover 108 coincides with the lower edge of cover 108 as shown in FIG. 4. Pasting identification tape 301 in this way prevents identification tape 301 from pasting to transfer film 106 by letting it hang over the edge of cover 108. Furthermore, since the pasting position of identification tape 301 is fixed, it is easier to paste identification tape 301.

Figure 5:
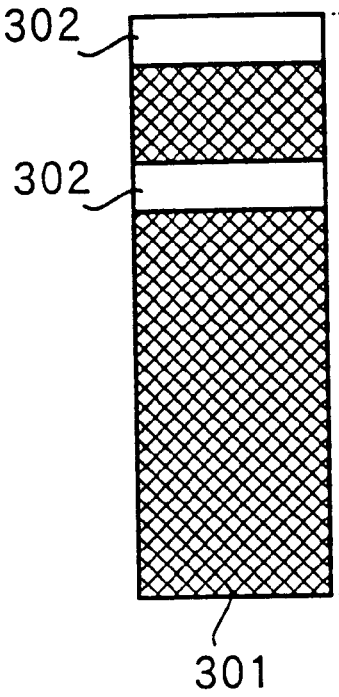
FIG. 5A is an enlarged view of the front of an identification tape used for the transfer unit according to the embodiment above.
FIG. 5B is an enlarged view of the back of the identification tape used for the transfer unit according to the embodiment above.
FIG. 5C is an enlarged view of a register mark used for the transfer unit according to the embodiment above.
Figure 5:
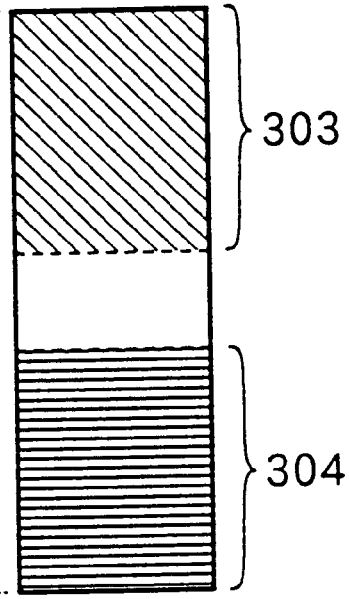
Figure 5:
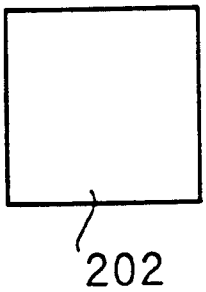

FIG. 5 shows enlarged views of identification tape 301 and register mark 202. FIG. 5A and FIG. 5B show enlarged views of the front and back of identification tape 301, respectively. FIG. 5C shows an enlarged view of register mark 202.

As shown in FIG. 5A, identification mark 302 is provided at one end of identification tape 301. Identification mark 302 is made of a material of high optical reflectivity as in the case of register mark 202. Identification mark 302 is also divided into a plurality of portions. FIG. 5A shows a case where identification mark 302 is divided into two portions. Detection sensor 112 emits light toward this identification mark 302. Detection sensor 112 then detects reflected light from identification mark 302 twice during a predetermined time interval to detect identification tape 301. This allows detection sensor 112 to detect that transfer unit 105 is an unused unit.

Here, the area between two identification marks 302 is set to be almost equal to the area of register mark 202. This allows single detection sensor 112 to detect both identification mark 302 and register mark 202 without the need to provide any additional detection sensor.

Furthermore, regarding the back side of identification tape 301 shown in FIG. 5B, area 303 on the identification mark 302 side is set to have less adhesion than that of area 304 opposite to identification mark 302. That is, area 303 on the identification mark 302 side is peeled more easily than area 304 opposite to identification mark 302.

Figure 6:
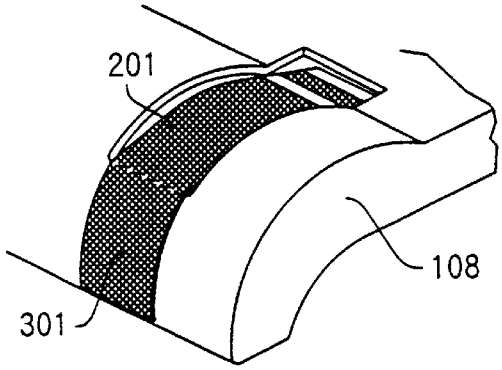
FIG. 6A is an enlarged view around the opening when the transfer unit according to the embodiment above is an unused unfit.
FIG. 6B is an enlarged cross-sectional view around the opening when the transfer unit according to the embodiment above is an unused unit.
Figure 6:
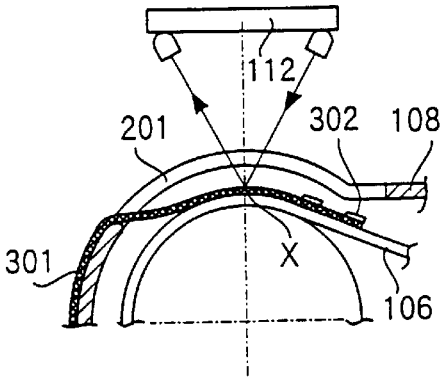
Figure 7:
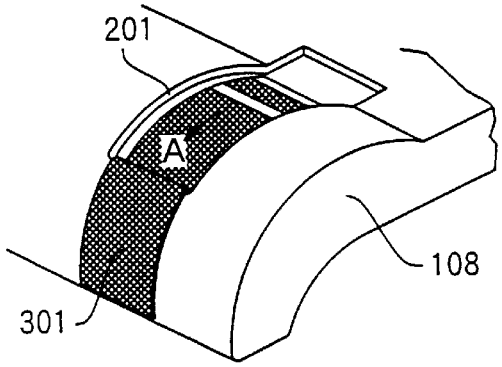
FIG. 7A is an enlarged view around the opening when the transfer unit according to the embodiment above starts to be used.
FIG. 7B is an enlarged cross-sectional view around the opening when the transfer unit according to the embodiment above starts to be used.
Figure 7:
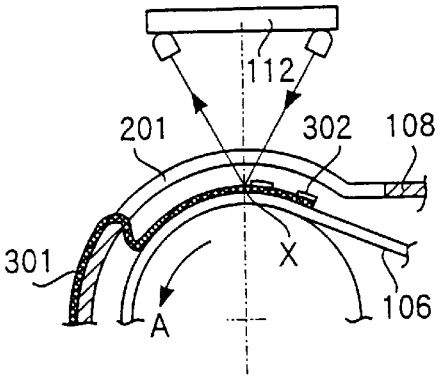
Figure 8:
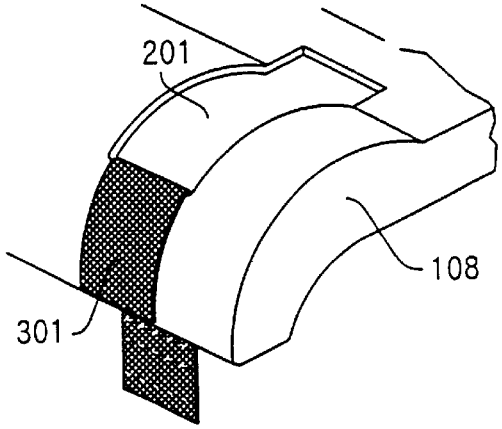
FIG. 8A is an enlarged view when the identification tape of the transfer unit according to the embodiment above is peeled off.
FIG. 8B is an enlarged cross-sectional view when the identification tape of the transfer unit according to the embodiment above is peeled off.
Figure 8:
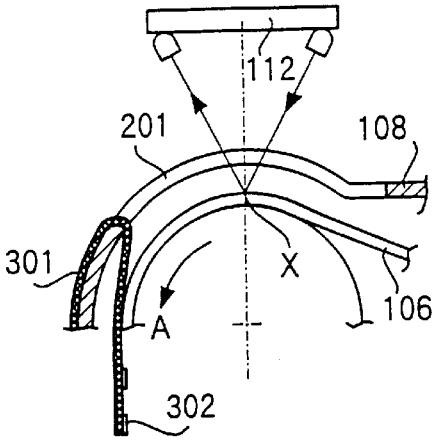

Next, the operation of detecting unused transfer unit 105 by this recording apparatus 100 is explained using FIG. 6 to FIG. 8. FIG. 6 shows an enlarged view around opening 201 of unused transfer unit 105. FIG. 7 shows an enlarged view around opening 201 when transfer film 106 starts to move. FIG. 8 shows an enlarged view around opening 201 when identification tape 301 is peeled off transfer film 106 as transfer film 106 moves.

When unused transfer unit 105 is mounted in recording apparatus 100, as shown in FIG. 6A, one end of identification tape 301 is pasted to cover 108 and the other end is pasted to transfer film 106 through opening 201. At this time, transfer film 106 cannot move.

FIG. 6B shows a cross-sectional view around this opening 201. As shown in FIG. 6B, detection sensor 112 emits light toward predetermined detection position X through opening 201 and monitors the reflected light. When unused transfer unit 105 is mounted in recording apparatus 100, the area other than identification mark 302 of identification tape 301 is located at detection position X. Therefore, detection sensor 112 receives no reflected light from identification tape 301.

After transfer unit 105 is mounted in recording apparatus 100, the user gives an instruction for recording an image. In response to the instruction for recording the image, the drive motor drives transport roller 109. In synchronization with this, transfer film 106 moves in the direction shown by arrow A in FIG. 7. When transfer film 106 moves in the direction of arrow A, the portion of identification tape 301 pasted to transfer film 106 also moves in the direction of arrow A in synchronization with transfer film 106. Thus, identification mark 302 also moves in the direction of arrow A.

FIG. 7B shows a cross-sectional view around opening 201 in this case. As shown in FIG. 7B, identification mark 302 approaches detection position X of detection sensor 112 in synchronization with transfer film 106. When identification mark 302 reaches detection position X, detection sensor 112 receives a first reflected light from identification mark 302. Then, after a short interval of receiving no reflected light, detection sensor 112 receives a second reflected light from identification mark 302. At this time, since detection sensor 112 receives the reflected light twice during a predetermined time interval, detection sensor 112 detects that identification tape 301 is pasted to transfer unit 105. This allows a determination section (for example, CPU) of recording apparatus 100 to detect that transfer unit 105 is an unused unit.

Once transfer unit 105 detects that transfer unit 105 is an unused unit, recording apparatus 100 resets the development counter provided inside the apparatus. By doing so, recording apparatus 100 recounts the number of times development of transfer unit 105 has been carried out. As a result, recording apparatus 100 keeps track of the timing of replacing transfer unit 105.

On the other hand, when transfer film 106 moves in the direction of arrow A, as shown in FIG. 8, identification tape 301 is caught in the direction of arrow A. At this time, regarding the adhesion of the back side of identification tape 301, the area on the identification mark 302 is peeled more easily than the area opposite to identification mark 302. For this reason, when identification tape 301 is caught in the direction of arrow A, identification tape 301 starts to peel starting from the portion of identification tape 301 pasted to transfer film 106. Identification tape 301 peeled off transfer film 106 is caught in by cover 108 with its adhesive surface facing the back of cover 108.

When transfer film 106 further moves, as shown in FIG. 8A, identification tape 301 is completely peeled off transfer film 106. Identification tape 301, which is peeled off transfer film 106, is kept with its adhesive surface facing the back of cover 108 or stuck to the back of cover 108. Because of this, peeled identification tape 301 does not interfere with the movement of transfer film 106 or the detection operation of detection sensor 112.

FIG. 8B shows a cross-sectional view around opening 201. As shown in FIG. 8B, transfer film 106 is completely released from identification tape 301. Therefore, transfer film 106 moves singly. When transfer film 06 starts to move singly, detection sensor 112 only receives the reflected light from register mark 202 provided on transfer film 106. Therefore, after identification tape 301 is peeled off transfer film 106, it is possible to continue image recording operation in the same way as normal operation of transfer unit 105.

As shown above, recording apparatus 100 of this embodiment is provided with identification tape 301 indicating whether transfer unit 105 is an unused unit or not pasted to opening 201 for detecting register mark 202. Detection sensor 112 for detecting register mark 202 detects identification mark 302 of this identification tape 301. This makes it possible to reliably detect whether transfer unit 105 is an unused unit or not with a simple configuration without increasing the number of parts.

Moreover, according to recording apparatus 100 of this embodiment, identification tape 301 peels off transfer film 106 as transfer film 106 moves. The adhesive surface of peeled identification tape 106 remains facing the back of cover 108 or pasted to the back of cover 108. For this reason, identification tape 301 does not interfere with the movement of transfer film 106 or cause misoperation of detection sensor 112. Therefore, after identification tape 301 is peeled off transfer film 106, recording apparatus 100 can continue normal image recording operation.

Furthermore, according to recording apparatus 100 of this embodiment, identification mark 302 is divided into a plurality of portions and detection sensor 112 detects that transfer unit 105 is an unused unit when detection sensor 112 receives the reflected light from this identification marks 302 by the number of times corresponding to the number of identification marks 302. At this time, the area between the plurality of identification marks 302 is set to have approximately the same area as that of register mark 202. Therefore, it is possible to detect whether transfer unit 105 is an unused unit or not using existing detection sensor 112 for detecting register mark 202 without installing any additional sensor for detecting identification mark 302.

Furthermore, this embodiment describes detection sensor 112 that detects whether transfer unit 105 is an unused unit or not by emitting light toward identification mark 302 made of a light reflecting material and receiving the reflected light. However, the present invention is not limited to such detection sensor 112 alone, but this sensor can also be replaced by a penetration type detection sensor. The apparatus with such a sensor can also attain the same effect as that of this embodiment.

Figure 9:
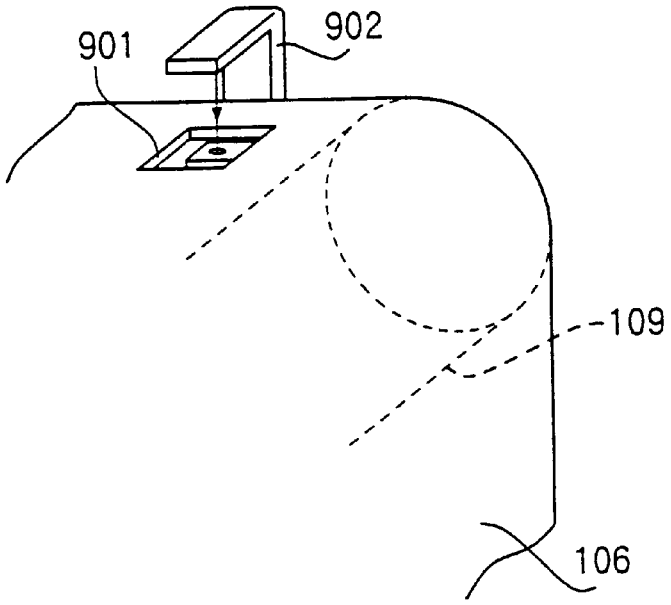
FIG. 9A illustrates a modification example of a detection sensor in the transfer unit according to the embodiment above.
FIG. 9B is another illustration of the modification example of the detection sensor in the transfer unit according to the embodiment above.
Figure 9:
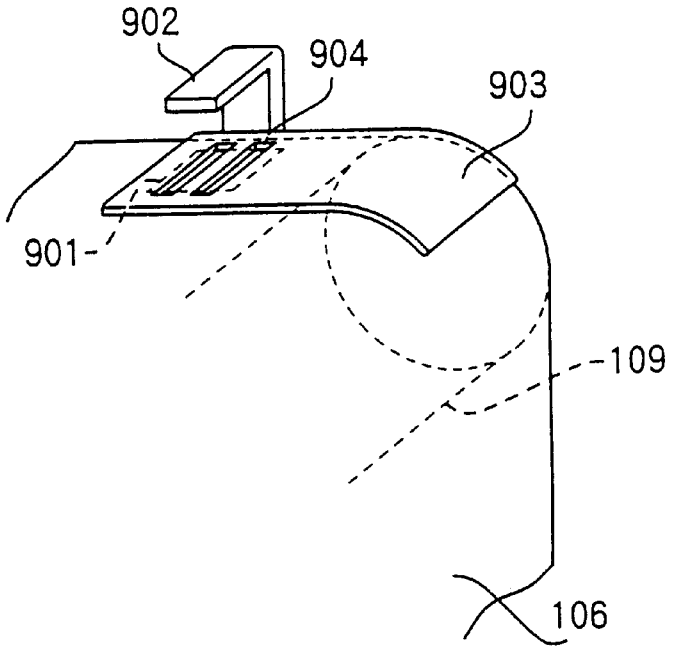

In this case, as shown in FIG. 9A, opening 901, which is used as a register mark, is provided at a predetermined position at one end of transfer film 106. Then, penetration type detection sensor 902 is placed at a location where opening 901 passes in such a way that transfer film 106 is sandwiched. Penetration type detection sensor 902 consists of a light-emitting device and photoreceptor device. Penetration type detection sensor 902 detects the register mark by the photoreceptor device receiving the light from the light-emitting device only when opening 901 arrives at the detection position. On the other hand, as shown in FIG. 9B, identification tape 903 is pasted to opening 901 for unused transfer unit 105. This identification tape 903 has two slits 904 formed, which will be placed just above opening 901. Penetration type detection sensor 902 detects identification tape 903 when the photoreceptor device receives light from the light-emitting device twice through slits 904 during a predetermined interval. This allows the penetration type detection sensor 902 to detect whether transfer unit 105 is an unused unit or not.

Furthermore, this embodiment describes identification tape 301 with the adhesion on the transfer film 106 side is set to be weaker than the adhesion on the cover 108 side. However, the present invention is not limited to this, but it is also possible to set the adhesion on the transfer film 106 side to be weaker by differentiating the area of adhesive surface of identification tape 301. The apparatus with such a modification can also attain the same effect as that of recording apparatus 100 of this embodiment.

As described above, the present invention allows the existing detection sensor to detect an identification tape that can detect an unused transfer unit, making it possible to reliably detect whether the transfer unit is an unused unit or not with a simple configuration without increasing the number of parts.

The present invention is not limited to the above described embodiments, and various variations and modifications may be possible without departing from the scope of the present invention.

This application is based on the Japanese Patent Application No.HEI11-197453 filed on Jul. 12, 1999, entire content of which is expressly incorporated by reference herein.

What is claimed is:

1. A transfer unit, comprising:

a transfer medium on which a color image is formed by superimposing a plurality of color images;

a cover that covers said transfer medium and has an opening that exposes part of said transfer medium; and a seal having one end pasted to said transfer medium through said opening and the other end pasted to said cover near said opening in the direction in which said transfer medium moves, said one end having an identification mark for use by a determination section of a recording apparatus to detect whether said transfer unit is an unused unit or not.

2. The transfer unit according to claim 1, further comprising a used toner box provided inside space surrounded with a circulation path of said transfer medium, said used toner box collecting used toner remaining on said transfer medium after transferring said color image to a recording sheet.

3. The transfer unit according to claim 1, wherein one end of said seal pasted to said transfer medium is peeled more easily than the other end pasted to said cover.

4. A recording apparatus, comprising:

a transfer unit having:

a transfer medium on which a color image is formed by superimposing a plurality of color images;

a cover that covers said transfer medium and has an opening that exposes part of said transfer medium; and a seal having one end pasted to said transfer medium through said opening with an identification mark and the other end pasted to said cover near said opening in the direction in which said transfer medium moves;

a sensing device that detects a register mark provided on said transfer medium through said opening for positioning when superimposing said plurality of color images over said transfer medium and also detects said identification mark provided on said seal; and a determination section that determines said transfer unit is an unused unit when said identification mark is detected by said sensing device.

5. A recording apparatus, comprising:

a transfer unit having:

a transfer medium on which a color image is formed by superimposing a plurality of color images;

a cover that covers said transfer medium and has an opening that exposes part of said transfer medium;

a seal having one end pasted to said transfer medium through said opening with an identification mark and the other end pasted to said cover near said opening in the direction in which said transfer medium moves; and a used toner box provided inside space surrounded with a circulation path of said transfer medium, said used toner box collecting used toner remaining on said transfer medium after transferring said color image to a recording sheet;

a sensing device that detects a register mark provided on said transfer medium through said opening for positioning when superimposing said plurality of color images over said transfer medium and also detecting said identification mark provided on said seal; and a determination section that determines said transfer unit is an unused unit when said identification mark is detected by said sensing device.

6. The recording apparatus according to claim 4, wherein said sensing device detects said seal by detecting an identification mark of a shape different from that of said register mark.

7. The recording apparatus according to claim 6, wherein said identification mark and said register mark have approximately a same area, one having a single detection surface and the other having a plurality of detection surfaces divided in the area.

8. The recording apparatus according to claim 7, wherein said identification mark has a plurality of detection surfaces and said register mark has a single detection surface.

9. The recording apparatus according to claim 7, wherein said register mark has a plurality of detection surfaces and said identification mark has a single detection surface.

10. The recording apparatus according to claim 4, wherein, if said transfer medium moves, one end of said seal remains pasted to said cover and the other end peels off as said transfer medium moves and does not return to the detection position of said sensing device.

* * * * *

UNITED STATES PATENT AND TRADEMARK OFFICE

CERTIFICATE OF CORRECTION

PATENT NO. : 6,229,967 B1
DATED : May 8, 2001
INVENTOR(S) : S. Miya et al.

It is certified that error appears in the above-identified patent and that said Letters Patent is hereby corrected as shown below:

Title page,
Item [73], Assignee, "Communications" should be -- Communication --.

Signed and Sealed this

Second Day of April, 2002

*Attest:*

*Attesting Officer*

JAMES E. ROGAN
*Director of the United States Patent and Trademark Office*